US009005510B2

(12) United States Patent
Ishaque et al.

(10) Patent No.: US 9,005,510 B2
(45) Date of Patent: Apr. 14, 2015

(54) PROCESSES FOR PRODUCING POLYMER FIBERS BY ELECTROSPINNING, COLLOIDAL DISPERSIONS FOR USE THEREIN, AND POLYMER FIBERS PREPARED BY SUCH PROCESSES

(75) Inventors: Michael Ishaque, Mannheim (DE); Andreas Greiner, Amöneburg (DE); Joachim H. Wendorff, Marburg (DE)

(73) Assignee: BASF SE (DE)

( * ) Notice: Subject to any disclaimer, the term of this patent is extended or adjusted under 35 U.S.C. 154(b) by 1616 days.

(21) Appl. No.: 11/817,061

(22) PCT Filed: Feb. 18, 2006

(86) PCT No.: PCT/DE2006/000296

§ 371 (c)(1),
(2), (4) Date: Jan. 24, 2008

(87) PCT Pub. No.: WO2006/089522

PCT Pub. Date: Aug. 31, 2006

(65) Prior Publication Data

US 2008/0261043 A1 Oct. 23, 2008

(30) Foreign Application Priority Data

Feb. 24, 2005 (DE) ..... 10 2005 008 926

(51) Int. Cl.
*D01D 5/38* (2006.01)
*D01D 5/00* (2006.01)

(52) U.S. Cl.
CPC ..... *D01D 5/003* (2013.01); *D01D 5/0038* (2013.01)

(58) Field of Classification Search
USPC ..... 264/465
See application file for complete search history.

(56) References Cited

U.S. PATENT DOCUMENTS

| | | | | |
|---|---|---|---|---|
| 4,243,480 | A * | 1/1981 | Hernandez et al. | 162/141 |
| 5,869,180 | A | 2/1999 | Büdenbender et al. | |
| 6,667,099 | B1 | 12/2003 | Greiner et al. | |
| 6,737,447 | B1 * | 5/2004 | Smith et al. | 523/105 |
| 6,753,454 | B1 * | 6/2004 | Smith et al. | 602/41 |
| 7,255,820 | B2 | 8/2007 | Lee et al. | |

(Continued)

FOREIGN PATENT DOCUMENTS

| | | | |
|---|---|---|---|
| DE | 19600162 | A1 | 7/1997 |
| DE | 10 355 665 | | 6/2004 |
| DE | 10133393 | A1 | 1/2006 |
| WO | WO-01/09414 | | 2/2001 |
| WO | WO-2005/096744 | A2 | 10/2005 |

OTHER PUBLICATIONS

Li, D. et al., "Electrospinning of Nanofibers:Reinventing the Wheel?", Adv. Mater., 2004, vol. 16, No. 14, 1151-1170.

(Continued)

*Primary Examiner* — Leo B Tentoni
(74) *Attorney, Agent, or Firm* — Drinker Biddle & Reath LLP

(57) ABSTRACT

Processes for forming polymer fibers, comprising: (a) providing a colloidal dispersion of at least one essentially water-insoluble polymer in an aqueous medium; and (b) electrospinning the colloidal dispersion; polymer fibers prepared by such processes; and colloidal dispersions comprising: at least one essentially water-insoluble polymer in an aqueous medium; and at least 10% by weight of a water-soluble polymer having a solubility in water of at least 0.1% by weight.

12 Claims, 4 Drawing Sheets

(56) References Cited

U.S. PATENT DOCUMENTS

Figure 1:
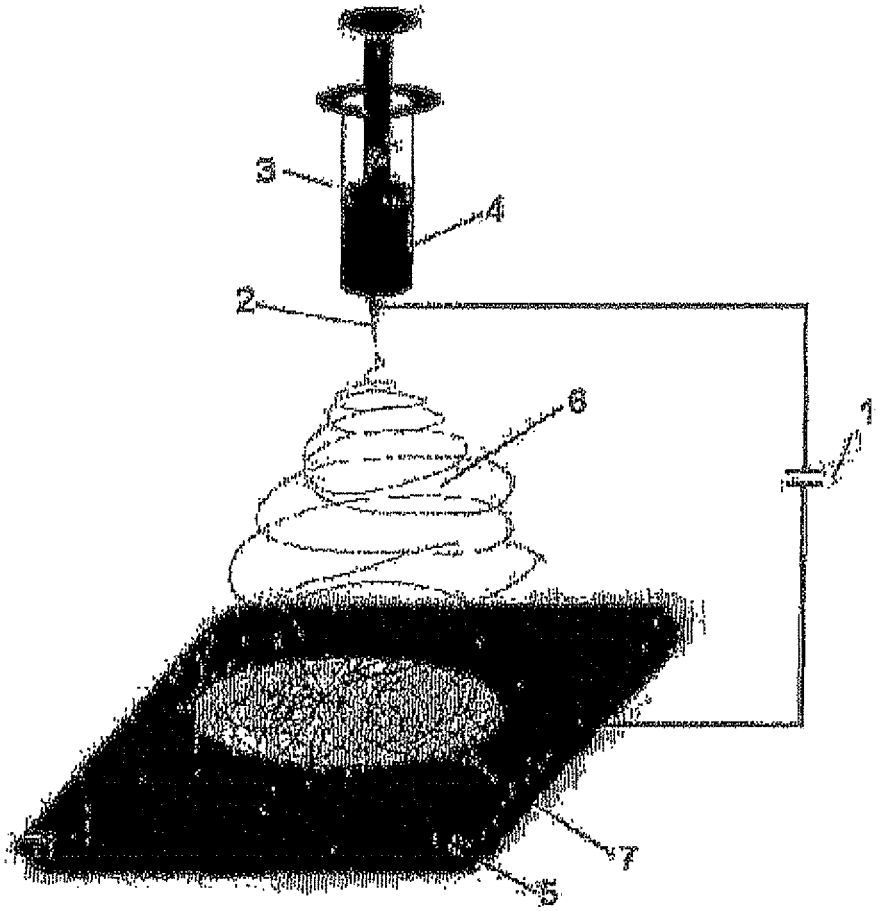

| | | | | |
|---|---|---|---|---|
| 2003/0006401 | A1* | 1/2003 | Haghighat et al. | 252/500 |
| 2003/0017208 | A1* | 1/2003 | Ignatious et al. | 424/486 |
| 2003/0026985 | A1 | 2/2003 | Greiner et al. | |
| 2004/0156904 | A1* | 8/2004 | Saltman et al. | 424/486 |
| 2007/0018361 | A1* | 1/2007 | Xu | 264/465 |
| 2007/0088114 | A1* | 4/2007 | Asgari | 524/431 |
| 2008/0290554 | A1* | 11/2008 | Wu et al. | 264/211.12 |

OTHER PUBLICATIONS

Reneker, D. H. et al., "Nanometre Diamter Fibres of Polymer, Produced by Electrospinning", Nanotechnology, 1996, vol. 7, pp. 216-223.

Norris, I. D. et al., "Electrostatic Fabrication of Ultrafine Conducting Fibers: Polyaniline/Polyethylene Oxide Blends", Synthetic Metals, 2000, vol. 114, pp. 109-114.

* cited by examiner

A B C

A B C

PROCESSES FOR PRODUCING POLYMER FIBERS BY ELECTROSPINNING, COLLOIDAL DISPERSIONS FOR USE THEREIN, AND POLYMER FIBERS PREPARED BY SUCH PROCESSES

CROSS-REFERENCE TO RELATED APPLICATIONS

This application is a national stage application, under 35 U.S.C. §371, of PCT/EP2006/000296, filed Feb. 18, 2006, which claims priority of German Application No. 10 2005 008 926.7, filed Feb. 24, 2005.

BACKGROUND OF THE INVENTION

The present invention relates to a process for producing polymer fibers, especially nano- and mesofibers, by the electrospinning process, and to fibers obtainable by this process.

For the production of nano- and mesofibers, a multitude of processes are known to those skilled in the art, among which electrospinning is currently of the greatest significance. In this process, which is described, for example, by D. H. Reneker, H. D. Chun in Nanotech. 7 (1996), page 216 ff., a polymer melt or a polymer solution is exposed to a high electrical field at an edge which serves as an electrode. This can be achieved, for example, by extrusion of the polymer melt or polymer solution in an electrical field under low pressure by a cannula connected to one pole of a voltage source. Owing to the resulting electrostatic charge of the polymer melt or polymer solution, there is a material flow directed toward the counterelectrode, which solidifies on the way to the counterelectrode. Depending on the electrode geometries, nonwovens or assemblies of ordered fibers are obtained by this process.

DE-A1-101 33 393 discloses a process for producing hollow fibers with an internal diameter of from 1 to 100 nm, in which a solution of a water-insoluble polymer—for example a poly-L-lactide solution in dichloromethane or a polyamide-46 solution in pyridine—is electrospun. A similar process is also known from WO-A1-01/09414 and DE-A1-103 55 665

DE-A1-196 00 162 discloses a process for producing lawnmower wire or textile fabrics, in which polyamide, polyester or polypropylene as a thread-forming polymer, a maleic anhydride-modified polyethylene/polypropylene rubber and one or more aging stabilizers are combined, melted and mixed with one another, before this melt is melt-spun.

The electrospinning of polymer melts allows only fibers of diameters greater than 1 μm to be produced. For a multitude of applications, for example filtration applications, however, nano- and/or mesofibers having a diameter of less than 1 μm are required, which can be produced with the known electrospinning processes only by use of polymer solutions.

However, these processes have the disadvantage that the polymers to be spun first have to be brought into solution. For water-insoluble polymers, such as polyamides, polyolefins, polyesters or polyurethanes and the like, nonaqueous solvents—regularly organic solvents—therefore have to be used, which are generally toxic, combustible, irritant, explosive and/or corrosive.

In the case of water-soluble polymers, such as polyvinyl alcohol, polyethylene oxide, polyvinylpyrrolidone, hydroxypropylcellulose and the like, it is possible to dispense with the use of nonaqueous solvents. However, fibers obtained in this way are by their nature water-soluble, which is why their industrial use is very limited. For this reason, these fibers have to be stabilized toward water after the electrospinning by at least one further processing step, for example by chemical crosslinking, which constitutes considerable technical complexity and increases the production costs of the fibers.

BRIEF SUMMARY OF THE INVENTION

The aim of the invention is to avoid these and further disadvantages of the prior art and to provide a process for preparing water-stable polymer fibers, especially nano- and mesofibers, by the electrospinning process, in which it is possible to dispense with the use of nonaqueous solvents to prepare a polymer solution and with an afertreatment of the electrospun fibers to stabilize them against water.

The present invention relates to processes for producing polymer fibers, in particular nano- and meso fibers, according to the electrospinning process, which comprises electrospinning a colloidal dispersion of at least one essentially water-insoluble polymer in an aqueous medium. The present invention also relates to fibers obtained by such processes.

The present invention further relates to colloidal dispersions of at least one essentially water-insoluble polymer in an aqueous medium further comprising at least 20% by weight of a water-soluble polymer having a solubility in water of at least 0.1% by weight.

The object is achieved in accordance with the invention by the provision of a process in which a colloidal dispersion of at least one essentially water-insoluble polymer is electrospun in an aqueous medium.

Surprisingly, it has been found in the context of the present invention that fibers with a high water resistance can be obtained when, instead of the polymer melts or polymer solutions used in the known electrospinning processes, colloidal dispersions of at least one essentially water-insoluble polymer in an aqueous medium are electrospun. In particular, it was surprising to the person skilled in the art that it was possible by the process according to the invention to produce nano- and mesofibers having a diameter of less than 1 μm, which was achievable by the processes known to date only by using polymer solutions. In an advantageous manner over the known processes based on the use of solutions of water-insoluble polymers, the process according to the invention dispenses with nonaqueous toxic, combustible, irritant, explosive and/or corrosive solvents. In addition, it is possible in the process according to the invention, unlike the known processes based on the use of aqueous solutions of water-soluble polymers, to dispense with a subsequent process step for water stabilization of the fibers.

According to the invention, in the process for producing polymer fibers, a colloidal dispersion of at least one essentially water-insoluble polymer is electrospun in an aqueous medium, essentially water-insoluble polymers being understood in the context of the invention to mean especially polymers having a solubility in water of less than 0.1% by weight.

In the context of the present invention, in agreement with textbook knowledge, a dispersion refers to a mixture of at least two mutually immiscible phases, at least one of the at least two phases being liquid. Depending on the state of matter of the second or further phase, dispersions are divided into aerosols, emulsions and suspensions, the second or further phase being gaseous in aerosols, liquid in emulsions and solid in suspensions. The colloidal polymer dispersions to be used in accordance with the invention are also referred to as latex in technical language.

In principle, the inventive colloidal polymer dispersions may be prepared by all processes known for this purpose to those skilled in the art, particularly good results being obtained especially by electrospinning latices produced by emulsion polymerization.

DETAILED DESCRIPTION OF THE INVENTION

In a preferred embodiment of the present invention, a colloidal aqueous dispersion of a water-insoluble polymer selected from the group consisting of poly(p-xylylene), polyvinylidene halides, polyesters, polyethers, polyethylene, polypropylene, poly(ethylene/propylene) (EPDM), polyolefins, polycarbonates, polyurethanes, natural polymers, polycarboxylic acids, polysulfonic acids, sulfated polysaccharides, polylactides, polyglycosides, polyamides, poly-α-methylstyrenes, polymethacrylates, polyacrylonitriles, polyacrylamides, polyimides, polyphenylenes, polysilanes, polysiloxanes, polybenzimidazoles, polybenzothiazoles, polyoxazoles, polysulfides, polyesteramides, polyarylenevinylenes, polyether ketones, polyurethanes, polysulfones, ormocerenes, polyacrylates, silicones, fully aromatic copolyesters, polyhydroxyethyl methacrylates, polymethyl methacrylates, polyethylene terephthalates, polybutylene terephthalate, polymethacrylonitriles, polyvinyl acetates, neoprene, Buna N, polybutadiene, polytetrafluoroethylene, modified and unmodified celluloses, homo- and copolymers of α-olefins. All aforementioned polymers may be used in each case individually or in any combination with one another in the latices to be used in accordance with the invention, and in any mixing ratio.

Good results are achieved especially with homo- or copolymers based essentially on acrylates, styrenes, vinyl acetates, vinyl ethers, butadienes, isoprenes, methacrylates, alpha-methylstyrenes, acrylamide, vinylsulfonic acid, vinylsulfonic esters, vinyl esters, vinyl alcohol, acrylonitrile, vinyl sulfonenes and/or vinyl halides.

All of the aforementioned polymers may be used in uncrosslinked or crosslinked form provided that their solubility in water is less than 0.1% by weight.

Particularly good results are achieved with colloidal polymer suspensions where the average particle diameter of the at least one essentially water-insoluble polymer is preferably between 1 nm and 1 μm. In general, the average particle diameter of the latex particles is between 0.03 μm and 2.5 μm, preferably between 0.05 μm and 1.2 μm (determined according to W. Scholtan and H. Lange in Kolloid Z. und Polymere 250 (1972), p. 782-796 by means of an ultracentrifuge).

When the latex to be used in accordance with the invention is based on two or more monomers, the latex particles may be arranged in any manner known to those skilled in the art. Mention should be made, merely by way of example, of particles with gradient structure, core-shell structure, salami structure, multicore structure, multilayer structure and raspberry morphology, although this structure is of only minor importance.

The term latex should also be understood to mean the mixture of two or more latices. The mixture can be prepared by all processes known for this purpose, for example by mixing two latices at any time before the mixing.

In a further preferred embodiment of the present invention, the colloidal dispersion comprises, in addition to the at least one water-insoluble polymer, additionally at least one water-soluble polymer, water-soluble polymer in the context of the present invention being understood to mean a polymer having a solubility in water of at least 0.1% by weight.

The water-soluble polymer may be a homopolymer, copolymer, block polymer, graft copolymer, star polymer, highly branched polymer, dendrimer or a mixture of two or more of the aforementioned polymer types. According to the findings of the present invention, the addition of at least one water-soluble polymer accelerates not only fiber formation. Instead, the quality of the fibers obtained is also significantly improved. When the fibers thus produced are contacted with water, the water-soluble polymer disappears without leading to disintegration of the fibers.

In principle, all water-soluble polymers known to those skilled in the art can be added to the colloidal dispersion of at least one essentially water-insoluble polymer in an aqueous medium, particularly good results being achieved with water-soluble polymers selected from the group consisting of polyethylene oxides, hydroxymethylcelluloses, hydroxyethylcelluloses, hydroxypropylcelluloses, carboxymethylcelluloses, maleic acids, alginates, collagens, polyvinyl alcohol, poly-N-vinylpyrrolidone, combinations thereof, copolymers thereof, graft copolymers thereof, star polymers thereof, highly branched polymers thereof, and dendrimers thereof.

The colloidal dispersions of at least one essentially water-insoluble polymer in an aqueous medium additionally comprising at least one water-soluble polymer according to the further embodiment of the invention can be prepared in any manner known to those skilled in the art, for example by emulsion polymerization.

Irrespective of the embodiment, the solids content of the colloidal dispersion to be used in accordance with the invention—based on the dispersion—is preferably from 5 to 80% by weight, more preferably from 10 to 70% by weight and most preferably from 10 to 65% by weight.

In the further embodiment of the present invention, the colloidal dispersion which is to be used in the process according to the invention and comprises at least one water-insoluble and at least one water-soluble polymer in an aqueous medium, based on the solids content of the dispersion, comprises from 0 to 120% by weight, more preferably from 10 to 80% by weight and most preferably from 17 to 70% by weight, of at least one water-soluble polymer.

The colloidal dispersion to be used in accordance with the invention can be electrospun in all ways known to those skilled in the art, for example by extrusion of the latex, under low pressure through a cannula connected to one pole of a voltage source to a counterelectrode arranged at a distance from the cannula exit. The distance between the cannula and the counterelectrode functioning as the collector, and the voltage between the electrodes, is preferably adjusted in such a way that an electrical field of preferably from 0.5 to 2 kV/cm, more preferably from 0.75 to 1.5 kV/cm and most preferably from 0.8 to 1 kV/cm forms between the electrodes.

Good results are achieved especially when the internal diameter of the cannula is from 50 to 500 μm.

Depending on the intended use of the fibers produced, it may be appropriate to subsequently bond them chemically to one another, or, for example, to crosslink them to one another by means of a chemical mediator. This allows, for example, the stability of one fiber layer formed by the fibers to be improved further, especially in relation to the water and thermal resistance.

The present invention further provides fibers, especially nano- and mesofibers, which are obtainable by the process according to the invention.

The diameter of the inventive fibers is preferably from 10 nm to 50 μm, more preferably from 50 nm to 2 μm and most preferably from 100 nm to 1 μm. The length of the fibers depends upon the intended use and is generally from 50 μm up to several kilometers.

The process according to the invention allows the production not just of compact fibers but in particular also hollow fibers, especially those having an internal diameter of less than 1 μm and more preferably of less than 100 nm. For the production of such hollow fibers, the fibers produced with the aforementioned process according to the invention can be coated, for example, with a substance selected from the group consisting of inorganic compounds, polymers and metals, and then the water-insoluble polymer present on the inside can be degraded, for example thermally, chemically, biologically, by radiation-induced means, photochemically, by means of plasma, ultrasound or extraction with a solvent. The materials suitable for coating and the methods suitable for dissolving the intra-fiber material are described, for example in DE-A1-101 33 393, which is hereby introduced as a reference and is considered to be part of the disclosure.

The present invention further relates to colloidal dispersions of at least one essentially water-insoluble polymer in an aqueous medium which additionally comprises at least 10% by weight of a water-soluble polymer having a solubility in water of at least from 0.1% by weight.

Further aims, features, advantages and possible uses of the invention are evident from the description of working examples which follows and the drawings. All features described and/or shown in image form, alone or in any combination, form the subject matter of the invention, irrespective of their combination in the claims or the claims to which they refer back.

THE FIGURES SHOW

Figure 2:
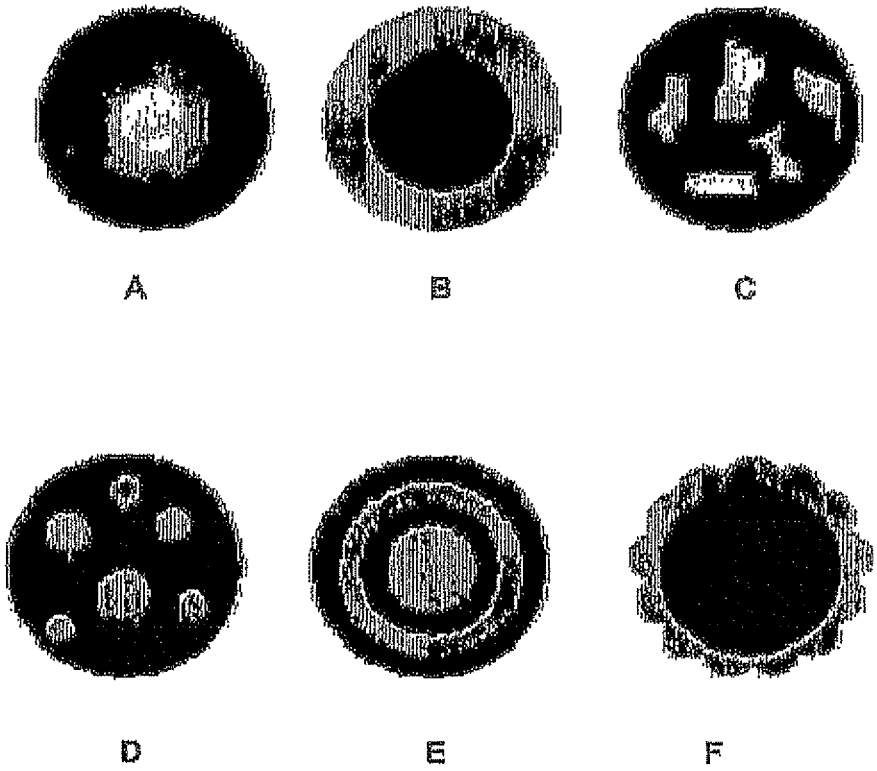
Figure 3:
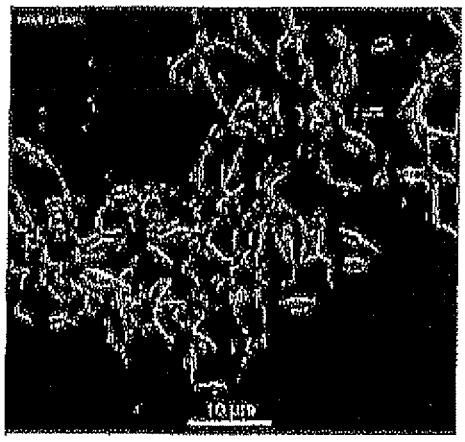
Figure 4:
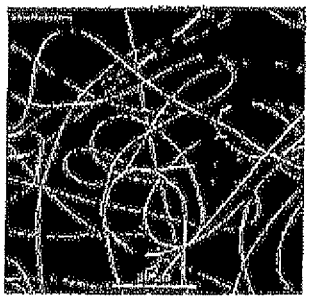
Figure 5:
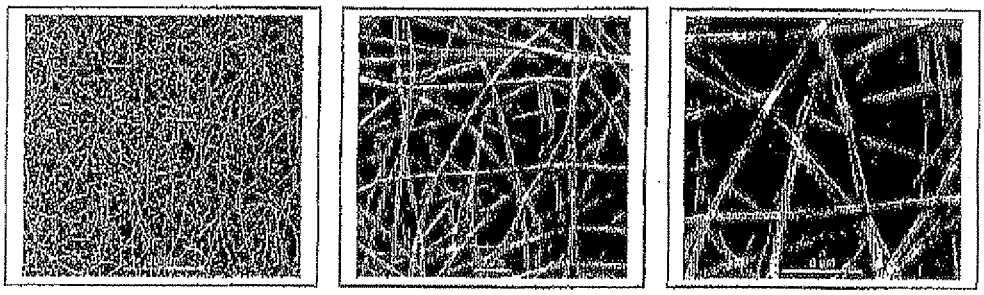
Figure 6:
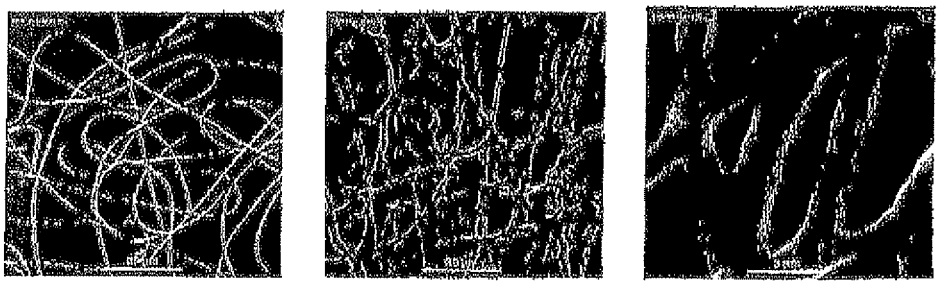

FIG. 1 a schematic illustration of an apparatus suitable for performing the electrospinning process according to the invention, FIG. 2 structures of different particles which are composed of two different polymers and are useable in the inventive latices, FIG. 3 a scanning electron micrograph of the fibers obtained in example 1, FIG. 4 a scanning electron micrograph of the fibers obtained in example 2, FIG. 5 scanning electron micrographs of the fibers obtained in example 3 and FIG. 6 scanning electron micrographs of the fibers obtained in example 4 before (A) and after water treatment (B, C).

The electrospinning apparatus which is shown in FIG. 1 and is suitable for performing the process according to the invention comprises a syringe 3 which is provided at its tip with a capillary die 2 connected to one pole of a voltage source 1 and is for accommodating the inventive colloidal dispersion 4. Opposite the exit of the capillary die 2, at a distance of about 20 cm, is arranged a square counterelectrode 5 connected to the other pole of the voltage source 1, which functions as the collector for the fibers formed.

During the operation of the apparatus, a voltage between 18 kV and 35 kV is set at the electrodes 2, 5, and the colloidal dispersion 4 is discharged under a low pressure through the capillary die 2 of the syringe 3. Owing to the electrostatic charge of the essentially water-insoluble polymers in the colloidal dispersion which results from the strong electrical field of from 0.9 to 2 kV/cm, a material flow directed toward the counterelectrode 5 forms, which solidifies on the way to the counterelectrode 5 with fiber formation 6, as a consequence of which fibers 7 with diameters in the micro- and nanometer range are deposited on the counterelectrode 5.

With the aforementioned apparatus, in accordance with the invention, a colloidal dispersion of at least one essentially water-insoluble polymer in an aqueous medium is electrospun. When the polymer particles used in the dispersion consist of two or more water-insoluble polymers, they may be arranged within the particles in any manner known to those skilled in the art, for example in the gradient structure shown in FIG. 2 (FIG. 2A), core-shell structure (FIG. 2B), salami structure (FIG. 2C), multicore structure (FIG. 2D), multilayer structure (FIG. 2E) or raspberry morphology (FIG. 2F).

The solids content within the dispersion is determined gravimetrically by means of a Mettler Toledo HR73 halogen moisture analyzer, by heating approx. 1 ml of the sample to 200° C. within 2 minutes and drying the sample to constant weight and then weighing it.

The mean particle size is the weight average $d_{50}$, determined by means of an analytical ultracentrifuge (according to W. Scholtan and H. Lange in Kolloid-Z. und Polymere 250 (1972), p. 782-796).

The size, i.e. the diameter and the length of the fibers, is determined by evaluating electron micrographs.

The latex used in the examples which follow consists of a partly crosslinked poly(n-butyl acrylate) with a solids content of about 40% by weight, based on the total weight of the pure dispersion. The emulsifier used is a C15-alkylsulfonate. The mean particle size is approx. 90 nm.

The water-soluble polymer used is polyethylene oxide (PEO). Its molecular weight is 900 000 g/mol.

EXAMPLE 1

(Electrospun Fibers Comprising Polyacrylate and 11% by Weight of PEO)

An inventive colloidal dispersion of at least one essentially water-insoluble polymer in an aqueous medium additionally comprising a water-soluble polymer according to the further embodiment of the present invention was prepared by dissolving 0.41 g of poly(n-butyl acrylate) in 1 ml of water. The solids content of the dispersion, i.e. of the poly(n-butyl acrylate) latex is consequently about 40% by weight. 0.045 g of polyethylene oxide (PEO) was added to this mixture.

The aqueous dispersion thus prepared was electrospun in the apparatus shown in FIG. 1. At a temperature of 20° C., the dispersion was conveyed at a sample feed rate of 0.525 ml/h under gentle pressure through a syringe 3 with a capillary die 2 having an internal diameter of 0.3 mm provided at its tip, the separation of the electrodes 2, 5 having been about 20 cm and a voltage of 18 kV having been applied between the electrodes 2, 5.

A scanning electron micrograph of the fibers obtained in this way is shown in FIG. 3.

EXAMPLE 2

(Electrospun Fibers Comprising Polyacrylate and 20% by Weight of PEO)

In this example, 0.084 g of polyethylene oxide was added to the poly(n-butyl acrylate) latex (0.41 g of poly(n-butyl acrylate) dissolved in 1 ml of water). This colloidal aqueous dispersion was electrospun under the conditions described in example 1.

A scanning electron micrograph of the fibers obtained in this way is shown in FIG. 4.

EXAMPLE 3

(Electrospun Fibers Comprising Polyacrylate and 70% by Weight of PEO)

A further inventive colloidal dispersion comprising at least one essentially water-insoluble polymer and an essentially water-soluble polymer was prepared by dissolving 0.34 g of poly(n-butyl acrylate) in 1 ml of water. The solids content of the poly(n-butyl acrylate) latex is consequently about 35% by weight. 0.238 g of polyethylene oxide (PEO) was added to this mixture.

This colloidal aqueous dispersion was also electrospun under the conditions specified in example 1. Scanning electron micrographs of the fibers obtained in this way are shown in FIG. 5.

EXAMPLE 4

(Electrospun Fibers Comprising Polyacrylate and 50% by Weight of PEO)

In the same way as in example 1, a colloidal dispersion of poly(n-butyl acrylate) latex having a solids content of 40% by weight in water with, based on the solids content, 50% by weight of polyethylene oxide as a water-soluble polymer was prepared and electrospun. Subsequently, the fibers thus obtained were incubated in water at 20° C.

Scanning electron micrographs of the fibers obtained before the water treatment, and after 1 min and 30 min of water treatment, are shown in FIG. 6. As can be seen from the micrographs, the electrospun fibers do not dissolve on incubation in water.

The invention is not restricted to one of the embodiments described, but rather can be modified in various ways. However, it can be seen that the present invention relates to a process for producing polymer fibers, especially nano- and mesofibers, by the electrospinning process, in which a colloidal dispersion of at least one essentially water-insoluble polymer, if appropriate further comprising at least one water-soluble polymer, is electrospun in an aqueous medium. The present invention further relates to fibers obtainable by this process.

All advantages and features evident from the claims, the description and the drawing, including construction details, spatial arrangements and process steps, may be essential to the invention either alone or in a wide variety of different combinations.

REFERENCE NUMERAL LIST

1 Voltage source
2 Capillary die
3 Syringe
4 Colloidal dispersion
5 Counterelectrode
6 Fiber formation
7 Fiber mat

The invention claimed is:

1. A process for forming polymer fibers, the process comprising:

(a) providing a colloidal dispersion of at least one essentially water-insoluble polymer in an aqueous medium; and (b) electrospinning the colloidal dispersion, wherein the at least one essentially water-insoluble polymer comprises a component selected from the group consisting of polyp-xylylene), polyesters, polyethers, polyethylene, polypropylene, poly(ethylene/propylene) (EPDM), polyolefins, polycarbonates, polyurethanes, natural polymers, polycarboxylic acids, polysulfonic acids, sulfated polysaccharides, polylactides, polyglycosides, polyamides, poly(alkyl) styrenes, polyacrylonitriles, polyacrylamides, polyimides, polyphenylenes, polysilanes, polysiloxanes, polybenzimidazoles, polybenzothiazoles, polyoxazoles, polysulfides, polyesteramides, polyarylenevinylenes, polyether ketones, polyurethanes, polysulfones, ormocerenes, silicones, fully aromatic copolyesters, poly(alkyl) acrylates, poly(alkyl) methacrylates, polyhydroxyethyl methacrylates, polyethylene terephthalates, polybutylene terephthalate, polymethacrylonitriles, polyvinyl acetates, polyisoprene, neoprene, Buna N, polybutadiene, polytetrafluoroethylene, modified and unmodified celluloses, homo- and copolymers of α-olefins, and combinations thereof.

2. The process according to claim 1, wherein the at least one essentially water-insoluble polymer has a solubility in water of less than 0.1% by weight.

3. The process according to claim 1, wherein the at least one essentially water-insoluble polymer comprises a component selected from the group consisting of homo- and copolymers comprised of acrylates, styrenes, vinyl acetates, vinyl ethers, butadienes, isoprenes, methacrylates, a-methylstyrenes, acrylamide, vinylsulfonic acid, vinylsulfonic esters, vinyl esters, vinyl alcohol, acrylonitrile, vinyl sulfonenes and combinations thereof.

4. The process according to claim 1, wherein the at least one essentially water-insoluble polymer in the colloidal dispersion has an average particle diameter of 1 nm to 1 μm.

5. The process according to claim 1, wherein the colloidal dispersion further comprises a water-soluble polymer having a solubility in water of at least 0.1% by weight.

6. The process according to claim 5, wherein the water-soluble polymer is selected from the group consisting of homopolymers, copolymers, graft copolymers, star polymers, highly branched polymers and dendrimers.

7. The process according to claim 5, wherein the water-soluble polymer is selected from the group consisting of polyethylene oxides, hydroxymethylcelluloses, hydroxyethylcelluloses, hydroxypropylcelluloses, carboxymethylcelluloses, maleic acids, alginates, collagens, polyvinyl alcohol, poly-N-vinylpyrrolidone, combinations thereof, copolymers thereof, graft copolymers thereof, star polymers thereof, highly branched polymers thereof, and dendrimers thereof.

8. The process according to claim 1, wherein the colloidal dispersion has a solids content of 5 to 80% by weight, based on the dispersion.

9. The process according to claim 5, wherein the water-soluble polymer is present in the colloidal dispersion in an amount up to 120% by weight, based on the solids content of the dispersion.

10. The process according to claim 1, wherein the polymer fibers formed are crosslinked or bonded chemically to one another.

11. A process for forming polymer fibers, the process comprising:

(a) providing a colloidal dispersion of at least one essentially water-insoluble polymer in an aqueous medium in the form of a latex produced by emulsion polymerization; and (b) electrospinning the colloidal dispersion.

12. A process for forming polymer fibers, the process comprising:

(a) providing a colloidal dispersion of at least one essentially water-insoluble polymer in an aqueous medium; and (b) electrospinning the colloidal dispersion, wherein the at least one essentially water-insoluble polymer comprises a component selected from the group consisting of poly(p-xylylene), polyesters, polyethers, polyethylene, polypropylene, poly(ethylene/propylene) (EPDM), polyolefins, polycarbonates, polyurethanes, natural polymers, polycarboxylic acids, polysulfonic acids, sulfated polysaccharides, polylactides, polyglycosides, polyamides, poly(alkyl)styrenes, polyacrylonitriles, polyacrylamides, polyimides, polyphenylenes, polysilanes, polysiloxanes, polybenzimidazoles, polybenzothiazoles, polyoxazoles, polysulfides, polyesteramides, polyarylenevinylenes, polyether ketones, polyurethanes, polysulfones, ormocerenes, silicones, fully aromatic copolyesters, poly(alkyl) acrylates, poly (alkyl) methacrylates, polyhydroxyethyl methacrylates, polyethylene terephthalates, polybutylene terephthalate, polymethacrylonitriles, polyvinyl acetates, polyisoprene, neoprene, Buna N, polybutadiene, polytetrafluoroethylene, modified and unmodified celluloses, homo- and copolymers of α-olefins, and combinations thereof, and wherein the colloidal dispersion further comprises a water-soluble polymer having a solubility in water of at least 0.1% by weight.

* * * * *